US005324407A

United States Patent [19]

Ernes et al.

[11] Patent Number: 5,324,407

[45] Date of Patent: Jun. 28, 1994

[54] SUBSTRATE OF IMPROVED PLASMA SPRAYED SURFACE MORPHOLOGY AND ITS USE AS AN ELECTRODE IN AN ELECTROLYTIC CELL

[75] Inventors: Lynne M. Ernes, Willoughby; Richard C. Carlson, Euclid; Kenneth L. Hardee, Middlefield, all of Ohio

[73] Assignee: ELTECH Systems Corporation, Chardon, Ohio

[21] Appl. No.: 23,445

[22] Filed: Feb. 26, 1993

Related U.S. Application Data

[63] Continuation of Ser. No. 633,914, Dec. 26, 1990, abandoned, which is a continuation-in-part of Ser. No. 374,429, Jun. 30, 1989, abandoned.

[51] Int. Cl.[5] ..... C25B 11/10; C25D 17/12

[52] U.S. Cl. ..... 204/242; 204/290 F; 204/280; 204/292; 428/639; 428/640; 428/161; 428/469

[58] Field of Search ..... 428/640, 670, 161, 469, 428/639; 204/242, 280, 290 F, 292; 429/44; 252/512, 518

[56] References Cited

U.S. PATENT DOCUMENTS

| | | | |
|---|---|---|---|
| 2,320,329 | 5/1943 | Meduna | 117/71 |
| 3,234,110 | 2/1966 | Beer | 204/38 |
| 3,265,526 | 8/1966 | Beer | 117/50 |
| 3,492,720 | 2/1970 | Guthke et al. | 29/592 |
| 3,573,100 | 3/1971 | Beer | 134/3 |
| 3,632,498 | 2/1968 | Beer | 204/290 F |
| 3,706,600 | 12/1972 | Pumphrey et al. | 134/3 |
| 3,711,385 | 6/1973 | Beer | 204/59 |
| 3,778,307 | 2/1968 | Beer et al. | 117/221 |
| 3,864,163 | 4/1975 | Beer | 117/217 |
| 3,878,083 | 4/1975 | DeNora et al. | 204/290 F |
| 3,882,002 | 5/1975 | Cook, Jr. | 204/98 |
| 3,950,240 | 4/1976 | Cookfair et al. | 204/290 F |
| 4,140,813 | 2/1979 | Hund et al. | 427/34 |
| 4,272,354 | 6/1981 | DeNora et al. | 204/290 |
| 4,392,927 | 7/1983 | Fabian et al. | 204/98 |
| 4,528,084 | 7/1985 | Beer et al. | 204/290 |
| 4,797,182 | 1/1989 | Beer et al. | 204/14.1 |
| 4,849,085 | 7/1989 | Debrodt et al. | 204/290 |
| 5,059,297 | 10/1991 | Hirao et al. | 204/290 F |

FOREIGN PATENT DOCUMENTS

| | | |
|---|---|---|
| 0090425 | 5/1983 | European Pat. Off. . |
| 0275083 | 7/1988 | European Pat. Off. . |
| 028703 | 10/1988 | European Pat. Off. . |
| 0407349 | 1/1991 | European Pat. Off. . |
| 1344540 | 4/1971 | United Kingdom . |

OTHER PUBLICATIONS

"Titanium Electrode for The Manufacture of Electrolytic Manganese Dioxide", K. Shimizu, Furukawa Electric Company, Ltd., Tokyo, Japan, pp. 233–236.

"Titanium As A Substrate for Electrodes", P. C. S. Hayfield, IMI plc, Kynock Works, Witton, Birmingham, England, pp. 1–25.

European Search Report EP 91 81 0992 w/annex Jan 1993.

*Primary Examiner*—Kathryn Gorgos

*Attorney, Agent, or Firm*—John J. Freer

[57] ABSTRACT

A metal surface is now described having enhanced adhesion of subsequently applied coatings. The substrate metal of the article, such as a valve metal as represented by titanium, is provided with a highly desirable surface characteristic for subsequent coating application. This can be achieved by a plasma sprayed coating of well defined surface morphology, the plasma spraying being with one or more metals usually valve metals. The metal of the coating may be the same or different from the metal of the substrate. Subsequently applied coatings, by penetrating into the coating of well defined surface morphology, and desirably locked onto the resulting metal article an provide enhanced lifetime even in rugged commercial environments.

36 Claims, No Drawings

SUBSTRATE OF IMPROVED PLASMA SPRAYED SURFACE MORPHOLOGY AND ITS USE AS AN ELECTRODE IN AN ELECTROLYTIC CELL

CROSS-REFERENCE TO RELATED APPLICATION

This is a continuation of application Ser. No. 07/633,914, filed Dec. 26, 1990, now abandoned, which is a continuation-in-part of U.S. patent application Ser. No. 374,429, filed Jun. 30, 1989, now abandoned.

BACKGROUND OF THE INVENTION

The adhesion of coatings applied directly to the surface of a substrate metal is of special concern when the coated metal will be utilized in a rigorous industrial environment. Careful attention is usually paid to surface treatment and pre-treatment operation prior to coating. Achievement particularly of a clean surface is a priority sought in such treatment or pre-treatment operation.

Representative of a coating applied directly to a base metal is an electrocatalytic coating, often containing a precious metal from the platinum metal group, and applied directly onto a metal such as a valve metal. Within this technical area of electrocatalytic coatings applied to a base metal, the metal may be simply cleaned to give a very smooth surface. U.S. Pat. No, 4,797,182. Treatment with fluorine compounds may produce a smooth surface. U.S. Pat. No. 3,864,163. Cleaning might include chemical degreasing, electrolytic degreasing or treatment with an oxidizing acid. U.S. Pat. No. 3,864,163.

Cleaning can be followed by mechanical toughening to prepare a surface for coating. U.S. Pat. No., 3,778,307. If the mechanical treatment is sandblasting, such may be followed by etching. U.S. Pat. No. 3,878,083. Or such may be followed by flame spray application of a fine-particled mixture of metal powders. U.S. Pat. No. 4,849,085.

Another procedure for anchoring the fresh coating to the substrate, that has found utility in the application of an electrocatalytic coating to a valve metal, is to provide a porous oxide layer which can be formed on the base metal. For example, titanium oxide can be flame or plasma sprayed onto substrate metal before application of electrochemically active substance, as disclosed in U.S. Pat. No. 4,140,813. Or the thermally sprayed material may consist of a metal oxide or nitride or so forth, to which electrocatalytically active particles have been preapplied, as taught in U.S. Pat. No. 4,392,927.

It has, however, been found difficult to provide long-lived coated metal articles for serving in the most rugged commercial environments, e.g., oxygen evolving anodes for use in the present-day commercial applications utilized in electrogalvanizing, electrotinning, electroforming or electrowinning. Such may be continuous operation. They can involve severe conditions including potential surface damage. It would be most desirable to .provide coated metal substrates to serve as electrodes in such operations, exhibiting extended stable operation while preserving excellent coating adhesion. It would also be highly desirable to provide such an electrode not only from fresh metal but also from recoated metal.

SUMMARY OF THE INVENTION

There has now been found a metal surface which provides a locked on coating of excellent coating adhesion. The coated metal substrate can have highly desirable extended lifetime even in most rigorous industrial environments. For the electrocatalytic coatings, the invention can provide for well anchored coatings of uniform planarity, even when utilizing gouged and similarly disfigured substrate metal.

In one aspect, the invention is directed to a metallic article of a substrate having a metal-containing surface adapted for enhanced coating adhesion, such surface comprising a plasma spray applied valve metal surface on said substrate, which plasma spray applied surface provides a profilometer-measured average surface roughness of at least about 250 microinches and an average surface peaks per inch of at least about 40, basis a profilometer upper threshold limit of 400 microinches and a profilometer lower threshold limit of 300 microinches.

In another aspect, the invention is directed to the method of preparing a plasma metal surface for enhanced coating adhesion which surface has been gouged and thereby exhibits loss of planarity, which method comprises:

Plasma spraying the gouges of such surface with a valve metal to establish metal surface planarity, and then plasma spraying the surface to be coated, including the plasma sprayed gouges to provide a surface roughness of enhanced coating adhesion.

In a still further aspect, the invention is directed to a cell for electrolysis having at least one electrode of a metal article as further defined herein. When the metal articles are electrocatalytically coated and used as oxygen evolving electrodes, even under the rigorous commercial operations including continuous electrogalvanizing, electrotinning, copper foil plating, electroforming or electrowinning, and including sodium sulfate electrolysis such electrodes can have highly desirable service life. Thus the invention is also directed to such metal articles as are utilized as electrodes.

DESCRIPTION OF THE PREFERRED EMBODIMENTS

The metals of the substrate are broadly contemplated to be any coatable metal. For the particular application of an electrocatalytic coating, the substrate metals might be such as nickel or manganese, but will most always be valve metals, including titanium, tantalum, aluminum, zirconium and niobium. Of particular interest for its ruggedness, corrosion resistance and availability is titanium. As well as the normally available elemental metals themselves, the suitable metals of the substrate can include metal alloys and intermetallic mixtures, as well as ceramics and cermets such as contain one or more valve metals. For example, titanium may be alloyed with nickel, cobalt, iron, manganese or copper. More specifically, Grade 5 titanium may include up to 6.75 weight % aluminum and 4.5 weight % vanadium, grade 6 up to 6% aluminum and 3% tin, grade 7 up to 0.25 weight % palladium, grade 10, from 10 to 13 weight % molybdenum plus 4.5 to 7.5 weight % zirconium and so on.

By use of elemental metals, alloys and intermetallic mixtures, it is most particularly meant the metals in their normally available condition, i.e., having minor amounts of impurities. Thus, for the metal of particular interest, i.e., titanium, various grades of the metal are available including those in which other constituents may be alloys or alloys plus impurities. Grades of titanium have been more specifically set forth in the standard specifications for titanium detailed in ASTM B 265-79.

Regardless of the metal selected and how the metal surface is subsequently processed, the substrate metal advantageously is a cleaned surface. This may be obtained by any of the treatments used to achieve a clean metal surface, but with the provision that unless called for to remove an old coating, and if etching might be employed, as more specifically detailed hereinbelow, mechanical cleaning is typically minimized. Thus, the usual cleaning procedures of degreasing, either chemical or electrolytic, or other chemical cleaning operation may be used to advantage.

Where an old coating is present on the metal surface, such needs to be addressed before recoating. It is preferred for best extended performance when the finished article will be used with an electrocatalytic coating, such as use as an oxygen evolving electrode, to remove the old coating. In the technical area of the invention which pertains to electrochemically active coatings on a valve metal, chemical means for coating removal are well known. Thus, a melt of essentially basic material, followed by an initial pickling will suitably reconstitute the metal surface, as taught in U.S. Pat. No. 3,573,100. Or a melt of alkali metal hydroxide containing alkali metal hydride, which may be followed by a mineral acid treatment, is useful, as described in U.S. Pat. No. 3,706,600. Usual rinsing and drying steps can also form a portion of these operations.

When a cleaned surface, or prepared and cleaned surface has been obtained, and particularly for later applying an electrocatalytic coating to a valve metal in the practice of the present invention, surface roughness is then obtained. This will be achieved by means which include plasma spray application, usually of particulate valve metal, most especially titanium powder. However, as described hereinbelow, although the metal will be applied in particulate form, the feed metal, i.e., the metal to be applied, may be in different form such as wire form. This should be understood even though for convenience, application will typically be discussed as metal applied in particulate form. In this plasma spraying, the metal is melted and sprayed in a plasma stream generated by heating with an electric arc to high temperatures an inert gas, such as argon or nitrogen, optionally containing a minor amount of hydrogen. It is to be understood by the use herein of the term "plasma spraying" that although plasma spraying is preferred the term is meant to include generally thermal spraying such as magnetohydrodynamic spraying, flame spraying and arc spraying.

The spraying parameters, such as the volume and temperature of the flame or plasma spraying stream, the spraying distance, the feed rate of particulate metal constituents and the like, are chosen so that the particulate metal components are melted by and in the spray stream and deposited on the metal substrate while still substantially in melted form so as to provide an essentially continuous coating (i.e. one in which the sprayed particles are not discernible) having a foraminous structure. Typically, spray parameters like those used in the examples give satisfactory coatings. Usually, the metal substrate during melt spraying is maintained near ambient temperature. This may be achieved by means such as streams of air impinging on the substrate during spraying or allowing the substrate to air cool between spray passes.

The particulate metal employed, e.g., titanium powder, has a typical particle size range of 20–100 microns, and preferably has all particles within the range of 40–80 microns for efficient preparation of surface roughness. Particulate metals having different particle sizes should be equally suitable so long as they are readily plasma spray applied. The metallic constituency of the particulates may be as above-described for the metals of the substrate, e.g., the titanium might be one of several grades most usually grade 1 titanium. It is also contemplated that mixtures may be applied, e.g., mixtures of metals or of metals with other substituents, which can include metal oxides, for example a predominant amount of metal with a minor amount of other substituents.

It is also contemplated that such plasma spray applications may be used in combination with etching of the substrate metal surface, with each treatment most always being applied to different portions of a surface. If etching is used, it is important to aggressively etch the metal surface to provide deep grain boundaries and well exposed, three-dimensional grains. It is preferred that such operation will etch impurities located at such grain boundaries.

Particularly where an old coating has been present and the coated substrate has been in use, e.g., as an anode in electrogalvanizing, the metal article can be disfigured and can have lost surface planarity. Typically, such disfiguring will be in nicks and gouges of the surface. For convenience, all such surface disfigurement, including nicks, scrapes, and gouges, and burns where metal may actually be melted and resolidify, will generally be referred to herein simply as "gouges." These may or may not be filled with a metal filling. If the overall surface were to be subsequently etched before recoating, the filled zones can be expected to yield poor etch results. Also, gouging of the substrate may be extensive, or the substrate from its heat history and/or chemistry may not achieve desirable results in etching. It may, therefore, be especially desirable to simply plasma spray the entire surface which can overcome these substrate deficiencies. It is also contemplated that it may be useful to combine plasma spray application with etching in some situations. Thus, gouges and the like may be filled by plasma spray technique. Usually, the areas of the surface which are not disfigured will first be etched, then the planar, etched areas can be masked, and the gouges remaining will be filled and/or surface treated by plasma spray application. That is, plasma spray can be used to fill and reactivate a gouge, or it simply can be used to just reactivate gouges without necessarily restoring surface planarity. By reactivation is meant the plasma spray application to prepare the gouge for subsequent treatment. Hence, the entire surface will have the needed roughness for coating, and if desired it may in the same processing be refurbished to desirable planarity.

When etching is utilized the heat treatment history of the metal can be important. For example, to prepare a metal such as titanium for etching, it can be most useful to condition the metal, as by annealing, to diffuse impurities to the grain boundaries. Thus, by way of example, proper annealing of grade 1 titanium will enhance the concentration of the iron impurity at grain boundaries. Where the suitable preparation includes annealing, and the metal is grade 1 titanium, the titanium can be annealed at a temperature of at least about 500° C. for a time of at least about 15 minutes. For efficiency of operation, a more elevated annealing temperature, e.g., 600°–800° C. is advantageous.

Where etching is employed, it will be with a sufficiently active etch solution to develop aggressive grain boundary attack. Typical etch solutions are acidic solutions. These can be provided by hydrochloric, sulfuric, perchloric, nitric, oxalic, tartaric, and phosphoric acids as well as mixtures thereof, e.g., aqua regia. Other etchants that may be utilized include caustic etchants such as a solution of potassium hydroxide/hydrogen peroxide in combination, or a melt of potassium hydroxide with potassium nitrate. For efficiency of operation, the etch solution is advantageously a strong, or concentrated solution, such as an 18–22 weight % solution of hydrochloric acid. Moreover, the solution is advantageously maintained during etching at elevated temperature such as at 80° C. or more for aqueous solutions, and often at or near boiling condition or greater, e.g., under refluxing condition. Following etching, the etched metal surface can then be subjected to rinsing and drying steps to prepare the surface for coating. A more detailed discussion of the etching and annealing can be found in U.S. patent application Ser. No. 374,429, the disclosure of which is incorporated herein by reference.

For the plasma spray applied surface roughness, it is necessary that the metal surface have an average roughness (Ra) of at least about 250 microinches and an average number of surface peaks per inch (Nr) of at least about 40. The surface peaks per inch can be typically measured at a lower threshold limit of 300 microinches and an upper threshold limit of 400 microinches. A surface having an average roughness of below about 250 microinches will be undesirably smooth, as will a surface having an average number of surface peaks per inch of below about 40, for providing the needed, substantially enhanced, coating adhesion. Advantageously, the surface will have an average roughness of on the order of about 400 microinches or more, e.g., ranging up to about 750–1500 microinches, with no low spots of less than about 200 microinches. Advantageously, for best avoidance of surface smoothness, the surface will be free from low spots that are less than about 210 to 220 microinches. It is preferable that the surface have an average roughness of from about 300 to about 500 microinches. Advantageously, the surface has an average number of peaks per inch of at least about 60, but which might be on the order of as great as about 130 or more, with an average from about 80 to about 120 being preferred. It is further advantageous for the surface to have an average distance between the maximum peak and the maximum valley (Rm) of at least about 1,000 microinches and to have an average peak height (Rz) of at least about 1,000 microinches. All of such foregoing surface characteristics are as measured by a profilometer. More desirably, the surface for coating will have an Rm value of at least about 1,500 microinches to about 3500 microinches and have a maximum valley characteristic of at least about 1,500 microinches up to about 3500 microinches.

After the substrate has attained the necessary surface roughness, it will be understood that the surface may then proceed through various operations, including pretreatment before coating. For example, the surface may be subjected to a cleaning operation, e.g., a solvent wash. Or it may be subjected to a subsequent etching or hydriding or nitriding treatment. Prior to coating with an electrochemically active material, it has been proposed to provide an oxide layer by heating the substrate in air or by anodic oxidation of the substrate as described in U.S. Pat. No. 3,234,110. European patent application No. 0,090,425 proposes to platinum electroplate the substrate to which then an oxide of ruthenium, palladium or iridium is chemideposited. Various proposals have also been made in which an outer layer of electrochemically active material is deposited on a sublayer which primarily serves as a protective and conductive intermediate. U.K. Patent No. 1,344,540 discloses utilizing and electrodeposited layer of cobalt or lead oxide under a ruthenium-titanium oxide or similar active outer layer. Various tin oxide based underlayers are disclosed in U.S. Pat. Nos. 4,272,354, 3,882,002 and 3,950,240. After providing the necessary surface roughness followed by any pretreatment operation, the coating most contemplated in the present invention is the application of electrochemically active coating.

As representative of the electrochemically active coatings that may then be applied to the etched surface of the metal, are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings in addition to those enumerated above include manganese dioxide, lead dioxide, palatinate coatings such as $M_xPt_3O_4$ where M is an alkali metal and X is typically targeted at approximately 0.5, nickel-nickel oxide and nickel plus lanthanide oxides.

It is contemplated that coatings will be applied to the metal by any of those means which are useful for applying a liquid coating composition to a metal substrate. Such methods include dip spin and dip drain techniques, brush application, roller coating and spray application such as electrostatic spray. Moreover spray application and combination techniques, e.g., dip drain with spray application can be utilized. With the above-mentioned coating compositions for providing an electrochemically active coating, a modified dip drain operation can be most serviceable. Following any of the foregoing coating procedures, upon removal from the liquid coating composition, the coated metal surface may simply dip drain or be subjected to other post coating technique such as forced air drying.

Typical curing conditions for electrocatalytic coatings can include cure temperatures of from about 300° C. up to about 600° C. Curing times may vary from only a few minutes for each coating layer up to an hour or more, e.g., a longer cure time after several coating layers have been applied. However, cure procedures duplicating annealing conditions of elevated temperature plus prolonged exposure to such elevated temperature, are generally avoided for economy of operation. In general, the curing technique employed can be any of those that may be used for curing a coating on a metal substrate. Thus, oven curing, including conveyor ovens may be utilized. Moreover, infrared cure techniques can be useful. Preferably for most economical curing, oven curing is used and the cure temperature used for electrocatalytic coatings will be within the range of from about 450° C. to about 550° C. At such temperatures, curing times of only a few minutes, e.g., from about 3 to 10 minutes, will most always be used for each applied coating layer.

The following examples show ways in which the invention has been practiced. However, the examples showing ways in which the invention has been practiced should not be construed as limiting the invention.

EXAMPLE 1

A titanium nut is welded to the back of each sample plate having an approximate 7.5 $cm^2$ sample face and each being unalloyed grade 1 titanium. The sample plates were then mounted to a large back plate to provide a mosaic of sample plates. This mounting scheme served to provide a large array of sample plates which could be handled as a unit in ensuing operations. The sample plates were grit blasted with aluminum oxide, then rinsed in acetone and dried.

A coating on the sample plates of titanium powder was produced using a powder having average particle size of 50–60 microns. The sample plates were coated with this powder using a Metco plasma spray gun equipped with a GH spray nozzle. The spraying conditions were: a current of 500 amps; a voltage of 45–50 volts; a plasma gas consisting of argon and helium; a titanium feed rate of 3 pounds per hour; a spray bandwidth of 6.7 millimeters (mm); and a spraying distance of 64 mm, with the resulting titanium layer on the titanium sample plates having a thickness of about 150 microns.

The coated surface of the sample plates were then subjected to surface profilometer measurement using a Hommel model T1000 C instrument manufactured by Hommelwerk GmbH. The plate surface profilometer measurements were determined as average values computed from three separate measurements conducted by running the instrument in random orientation across the coated flat face of the plate. This gave average values as measured on three sample plates for surface roughness (Ra) of 448, 490 and 548 microinches, respectively for the three plates, and peaks per inch (Nr) of 76, 63 and 76, respectively for the three plates. The peaks per inch were measured within the threshold limits of 300 microinches (lower) and 400 microinches (upper).

EXAMPLE 2

A sample of titanium which had been previously coated with an electrochemically active coating, was blasted with alumina powder to remove the previous coating. By this abrasive method, it was determined by X-ray fluorescence that the previous coating had been removed. After removal of any residue of the abrasive treatment, the resulting sample plate was etched. It was etched for approximately 1 hour by immersion in 20 weight percent hydrochloric acid aqueous solution heated to 95° C. After removal from the hot hydrochloric acid, the plate was again rinsed with deionized water and air dried. Under profilometer measurement conducted in the manner of Example 1, the resulting average values for a flat face surface of the sample were found to be 180 (Ra) and 31 (Nr).

The sample then received a coating of plasma spray applied titanium using the titanium powder and the application procedure as described in Example 1. Under profilometer measurement conducted in the manner of Example 1, the resulting average values for a flat surface of the sample were found to be 650 (Ra) and 69 (Nr).

We claim:

1. A cell for the electrolysis of a dissolved species contained in a bath of said cell and having an anode immersed in said bath, which cell has an anode having as its operative surface an electrochemically active surface coating on a substrate metal that has a roughened surface of plasma spray applied valve metal, said surface having a profilometer-measured average surface roughness of at least about 250 microinches and an average surface peaks per inch of at least about 40, with said peaks per inch being basis a lower profilometer threshold limit of 300 microinches and an upper profilometer threshold limit of 400 microinches.

2. The cell of claim 1, wherein said surface has a profilometer-measured average roughness of at least about 300 microinches with no low spots of less than about 210 microinches.

3. The cell of claim 1, wherein said surface has a profilometer-measured average surface peaks per inch of at least about 60, basis an upper threshold limit of 400 microinches and a lower threshold limit of 300 microinches.

4. The cell of claim 1, wherein said surface has profilometer-measured average distance between the maximum peak and the maximum valley of at least about 1,000 microinches.

5. The cell of claim 1, wherein said surface has a profilometer-measured average distance between the maximum peak and the maximum valley of from about 1,500 microinches to about 3,500 microinches.

6. The cell of claim 1, wherein said surface has a profilometer-measured average peaks height of at least about 1,000 microinches.

7. The cell of claim 1, wherein said surface has a profilometer measured average peaks height of from at least about 1,500 microinches up to about 300 microinches.

8. A metallic article of a titanium metal substrate having a titanium metal surface adapted for enhanced coating adhesion, with said surface, before coating, consisting of plasma spray applied titanium metal on said titanium metal substrate, which plasma spray applied titanium metal provides a titanium metal surface having a profilometer-measured average surface roughness of at least about 250 microinches and an average surface peaks per inch of at least about 40, basis a profilometer upper threshold limit of 400 microinches and a profilometer lower threshold limit of 300 microinches.

9. The article of claim 8, wherein said surface is a plasma spray applied surface obtained by application of titanium metal particles having size within the range of from 20 to 100 microns.

10. The article of claim 8, wherein said metallic article comprises an oxygen-evolving anode.

11. The article of claim 8, wherein said surface has a profilometer-measured average surface peaks per inch of at least about 60, basis an upper threshold limit of 400 microinches and a lower threshold limit of 300 microinches.

12. The article of claim 8, wherein said surface has profilometer-measured average distance between the maximum peak and the maximum valley of at least about 1,000 microinches.

13. The article of claim 8, wherein said surface has a profilometer-measured average peaks height of at least about 1,000 microinches.

14. The article of claim 8, wherein said surface of said applied titanium metal is coated.

15. The article of claim 8, wherein said metallic article has an outer, electrochemically active layer and a sub-layer, which sub-layer is on said surface of said applied titanium and serves as an intermediate layer.

16. A metallic article of a valve metal substrate having a valve metal surface adapted for enhanced coating adhesion, said surface having a plasma spray applied valve metal on said substrate, which plasma spray applied valve metal is obtained by plasma spraying metal consisting of valve metal onto said substrate, which plasma spray applied valve metal provides a profilometer-measured average surface roughness of at least about 250 microinches and an average surface peaks per inch of at least about 40, basis a profilometer upper threshold limit of 400 microinches and a profilometer lower threshold limit of 300 microinches.

17. The article of claim 16, wherein said valve metal substrate is one or more of valve metal, valve metal alloy, valve metal intermetallic mixture, valve-metal-containing ceramic or valve-metal containing cement.

18. The article of claim 16, wherein the metal of said surface is selected from the group consisting of the metals, the alloys and intermetallic mixtures among themselves, of titanium, tantalum, niobium, aluminum, zirconium, manganese and nickel.

19. The article of claim 16, wherein said surface is a plasma spray applied surface obtained by application of valve metal particles having a size within the range of from 20 to 100 microns.

20. The article of claim 16, wherein said metallic article comprises an oxygen-evolving anode.

21. The article of claim 16, wherein said metallic article comprises an electrode other than an oxygen-evolving anode.

22. The article of claim 16, wherein said metal surface has a profilometer-measured average roughness of at least about 300 microinches, with no low spots of less than about 210 microinches.

23. The article of claim 16, wherein said surface has a profilometer-measured average surface peaks per inch of at least about 60, basis an upper threshold limit of 400 microinches and a lower threshold limit of 300 microinches.

24. The article of claim 16, wherein said surface has profilometer-measured average distance between the maximum peak and the maximum valley of at least about 1,000 microinches.

25. The article of claim 16, wherein said surface has profilometer-measured average distance between the maximum peak and the maximum valley of from about 1,500 microinches to about 3,500 microinches.

26. The article of claim 16, wherein said surface has a profilometer-measured average peaks height of at least about 1,000 microinches.

27. The article of claim 16, wherein said surface has a profilometer-measured average peaks height of from at least about 1,500 microinches up to about 3,500 microinches.

28. The article of claim 16, wherein said surface of said applied valve metal is coated.

29. The article of claim 28, wherein said coated surface has an electrochemically active surface coating containing a platinum group metal, or metal oxide or their mixtures.

30. The article of claim 28, wherein said electrochemically active surface coating contains at least one oxide selected from the group consisting of platinum group metal oxides, magnetite, ferrite and cobalt oxide spinel.

31. The article of claim 28, wherein said electrochemically active surface coating contains a mixed crystal material of at least one oxide of a valve metal and at least one oxide of a platinum group metal.

32. The article of claim 28, wherein said coated surface has a coating containing one or more of manganese dioxide, lead dioxide, tin oxide, palatinate substituent, nickel-nickel oxide and nickel plus lanthanide oxides.

33. The article of claim 16, wherein said article is an anode in an anodizing, electroplating or electrowinning cell.

34. The article of claim 16, wherein said article is an anode in electrogalvanizing, electrotinning, sodium sulfate electrolysis or copper foil plating.

35. The article of claim 16, wherein said metallic article has an outer, electrochemically active layer and a sub-layer, which sub-layer is on said surface of said applied valve-metal and serves as an intermediate layer.

36. A cell for the electrolysis of a dissolved species contained in a bath of said cell and having an anode immersed in said bath, which cell has an anode having as its operative surface an electrochemically active surface and as its substrate a substrate metal that has a roughened surface of plasma spray applied valve metal, said surface having a profilometer-measured average surface roughness of at least about 250 microinches and an average surface peaks per inch of at least about 40, with said peaks per inch being basis a lower profilometer threshold limit of 300 microinches and an upper profilometer threshold limit of 400 microinches.

* * * * *